US009193425B2

(12) United States Patent
Kaneko et al.

(10) Patent No.: US 9,193,425 B2
(45) Date of Patent: Nov. 24, 2015

(54) JET PROPULSION BOAT

(71) Applicant: YAMAHA HATSUDOKI KABUSHIKI KAISHA, Iwata-shi, Shizuoka (JP)

(72) Inventors: Yoshiyuki Kaneko, Shizuoka (JP); Masaru Suzuki, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 454 days.

(21) Appl. No.: 13/891,217

(22) Filed: May 10, 2013

(65) Prior Publication Data

US 2014/0096506 A1 Apr. 10, 2014

(30) Foreign Application Priority Data

Oct. 5, 2012 (JP) ..... 2012-223184

(51) Int. Cl.
*B63H 11/11* (2006.01)
*B63H 11/08* (2006.01)
*B63H 21/21* (2006.01)

(52) U.S. Cl.
CPC ..... *B63H 11/08* (2013.01); *B63H 11/11* (2013.01); *B63H 21/21* (2013.01); *B63H 2021/216* (2013.01)

(58) Field of Classification Search
CPC ..... B63H 11/11; B63H 11/101; B63H 11/107
USPC ..... 440/38, 40, 41
See application file for complete search history.

(56) References Cited

U.S. PATENT DOCUMENTS 4,813,895 A 3/1989 Takahashi
6,729,918 B2 * 5/2004 Fuse ..... B63H 11/11 440/41
8,579,668 B2 * 11/2013 Minoura ..... B63H 11/107 440/41
2012/0285355 A1 * 11/2012 Walkowiak ..... B63H 25/382 114/163

FOREIGN PATENT DOCUMENTS

JP 62-258890 A 11/1987

* cited by examiner

*Primary Examiner* — S. Joseph Morano
*Assistant Examiner* — Andrew Polay
(74) *Attorney, Agent, or Firm* — Keating & Bennett, LLP

(57) ABSTRACT

A jet propulsion boat includes a boat body, an engine, a jet propulsion mechanism, and a reverse gate. The reverse gate is arranged rearward of the jet propulsion mechanism and is configured to move to a forward movement position that allows a jet flow from the jet propulsion mechanism to flow backward, a reverse movement position that allows the jet flow from the jet propulsion mechanism to flow forward and downward, and a neutral position that allows the jet flow from the jet propulsion mechanism to flow in the lateral direction. The reverse gate includes a first member and a second member. The first member includes a downward opening and a pair of lateral openings open to the right and left when the reverse gate is positioned in the neutral position. The second member covers at least a portion of the downward opening when the reverse gate is positioned in the neutral position.

11 Claims, 14 Drawing Sheets

JET PROPULSION BOAT

BACKGROUND OF THE INVENTION

1. Field of the Invention

The present invention relates to a jet propulsion boat.

2. Description of the Related Art

Japanese Laid-Open Patent Publication No. S62-258890 discloses a jet propulsion boat that includes a jet propulsion mechanism and a reverse gate that moves to change the direction of a jet flow from the jet propulsion mechanism. The reverse gate moves to a forward movement position that allows the jet flow to flow backward, a reverse movement position that allows the jet flow to flow forward and downward, and a neutral position that allows the jet flow to flow downward.

However, when the reverse gate is switched to the neutral position in the jet propulsion boat disclosed in Japanese Laid-Open Patent Publication No. S62-258890, a phenomenon in which the bow of the boat sinks into the water (so-called bow diving) occurs due to the jet flow from the jet propulsion mechanism flowing downward.

SUMMARY OF THE INVENTION

Preferred embodiments of the present invention provide a jet propulsion boat in which bow diving is prevented when the reverse gate is positioned in the neutral position.

A jet propulsion boat according to a preferred embodiment of the present invention includes a boat body, an engine, a jet propulsion mechanism, and a reverse gate. The reverse gate is arranged rearward of the jet propulsion mechanism and is arranged to be moved to a forward movement position that allows a jet flow from the jet propulsion mechanism to flow backward, a reverse movement position that allows the jet flow from the jet propulsion mechanism to flow forward and downward, and a neutral position that allows the jet flow from the jet propulsion mechanism to flow in the lateral direction. The reverse gate includes a first member and a second member. The first member includes a downward opening and a pair of lateral openings. The downward opening is open downward. The pair of lateral openings are open to the right and left when the reverse gate is positioned in the neutral position. The second member covers at least a portion of the downward opening when the reverse gate is positioned in the neutral position.

According to the preferred embodiments of the present invention disclosed herein, bow diving can be prevented when the reverse gate is positioned in the neutral position.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
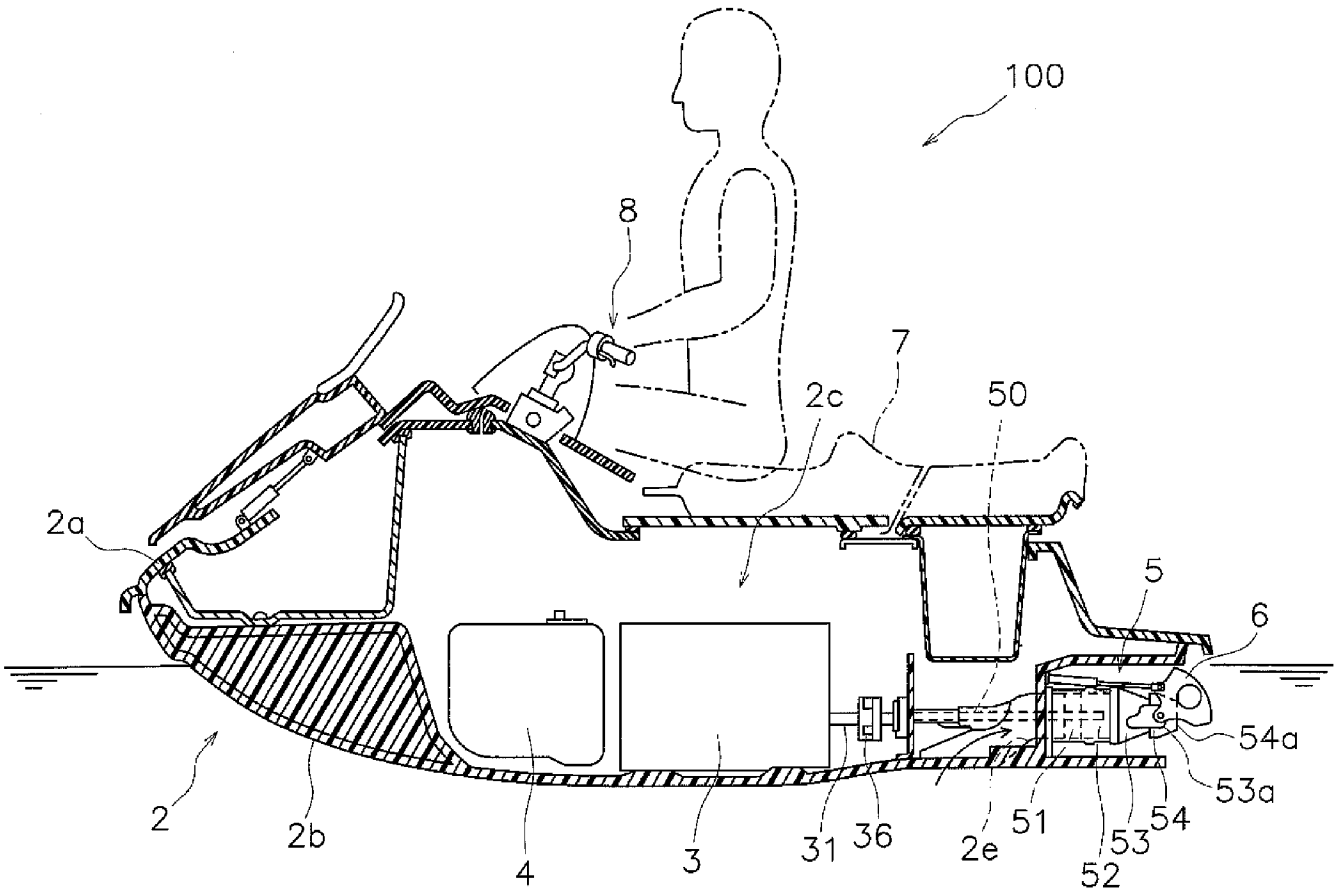
FIG. 1 is a cross-sectional view of a schematic configuration of a jet propulsion boat according to a first preferred embodiment of the present invention.

The following describes a schematic configuration of a jet propulsion boat 100 according to a first preferred embodiment with reference to the drawings. FIG. 1 is a cross-sectional view of a schematic configuration of a jet propulsion boat according to the first preferred embodiment.

The jet propulsion boat 100 preferably is a so-called personal watercraft (PWC). The jet propulsion boat 100 includes a boat body 2, an engine 3, a fuel tank 4, a jet propulsion mechanism 5, a reverse gate 6, a seat 7, and a steering handle 8.

The boat body 2 includes a deck 2*a* and a hull 2*b*. The seat 7 is attached to the deck 2*a*. The seat 7 is arranged above the engine 3. The steering handle 8 is arranged to steer the boat body 2 and is arranged in front of the seat 7.

An engine room 2*c* is provided inside the boat body 2. The engine room 2*c* houses the engine 3 and the fuel tank 4. The engine 3 includes a crankshaft 31. The crankshaft 31 is arranged so as to extend in the front-back direction.

The jet propulsion mechanism 5 generates propulsion power to propel the boat body 2 with a drive power from the engine 3. The jet propulsion mechanism 5 sucks in and sprays water around the boat body 2. The jet propulsion mechanism 5 preferably includes an impeller shaft 50, an impeller 51, an impeller housing 52, a nozzle 53, and a deflector 54.

The impeller shaft 50 is arranged to extend rearward from the engine room 2*c*. The front portion of the impeller shaft 50 is coupled to the crankshaft 31 through a coupling device 36. The rear portion of the impeller shaft 50 is inserted into the inside of the impeller housing 52 through a water suction device 2*e* of the boat body 2. The impeller housing 52 is coupled to a rear portion of the water suction device 2*e*.

The nozzle 53 is arranged rearward of the impeller housing 52. The impeller 51 is attached toward a rear portion of the impeller shaft 50. The impeller 51 is arranged inside of the impeller housing 52. The impeller 51 rotates with the impeller shaft 50 to suck in water from the water suction device 2*e*. The impeller 51 sprays the sucked in water backward from the nozzle 53. Supporting brackets 53*a* are fixed to the sides of the nozzle 53 to support the reverse gate 6.

The deflector 54 is arranged rearward of the nozzle 53. The deflector 54 includes a jet orifice 54 arranged to spray a jet flow from the jet propulsion mechanism rearward. The deflector 54 is configured to swing in the vertical and the lateral directions. The deflector 54 is configured to divert the spray direction of the water from the nozzle 53 to the left or to the right in response to a left or right operation of the steering handle 8. Specifically, when the steering handle 8 is turned to the left, the spray direction of the nozzle 53 is changed to diagonally left and backward, and when the steering handle 8 is turned to the right, the spray direction of the nozzle 53 is changed to diagonally right and backward. The deflector 54 is configured to divert the spray direction of the water from the nozzle 53 upward or downward in response to the operation of a trim adjustment switch provided on the steering handle 8.

The reverse gate 6 is arranged rearward of the jet propulsion mechanism 5. The reverse gate 6 is arranged to move so that the spray direction of the jet flow from the jet propulsion mechanism 5 is changed. Specifically, the reverse gate 6 is arranged to be moved to a forward movement position (see FIG. 5) that allows the jet flow from the jet propulsion mechanism 5 to flow backward, a neutral position (see FIG. 6) that allows the jet flow from the jet propulsion mechanism 5 to flow to the right and left (e.g., in both width directions of the boat body 2), and a reverse movement position (see FIG. 7) that allows the jet flow from the jet propulsion mechanism 5 to flow forward diagonally and downward. The configuration and operation of the reverse gate 6 are described below.

Figure 2:
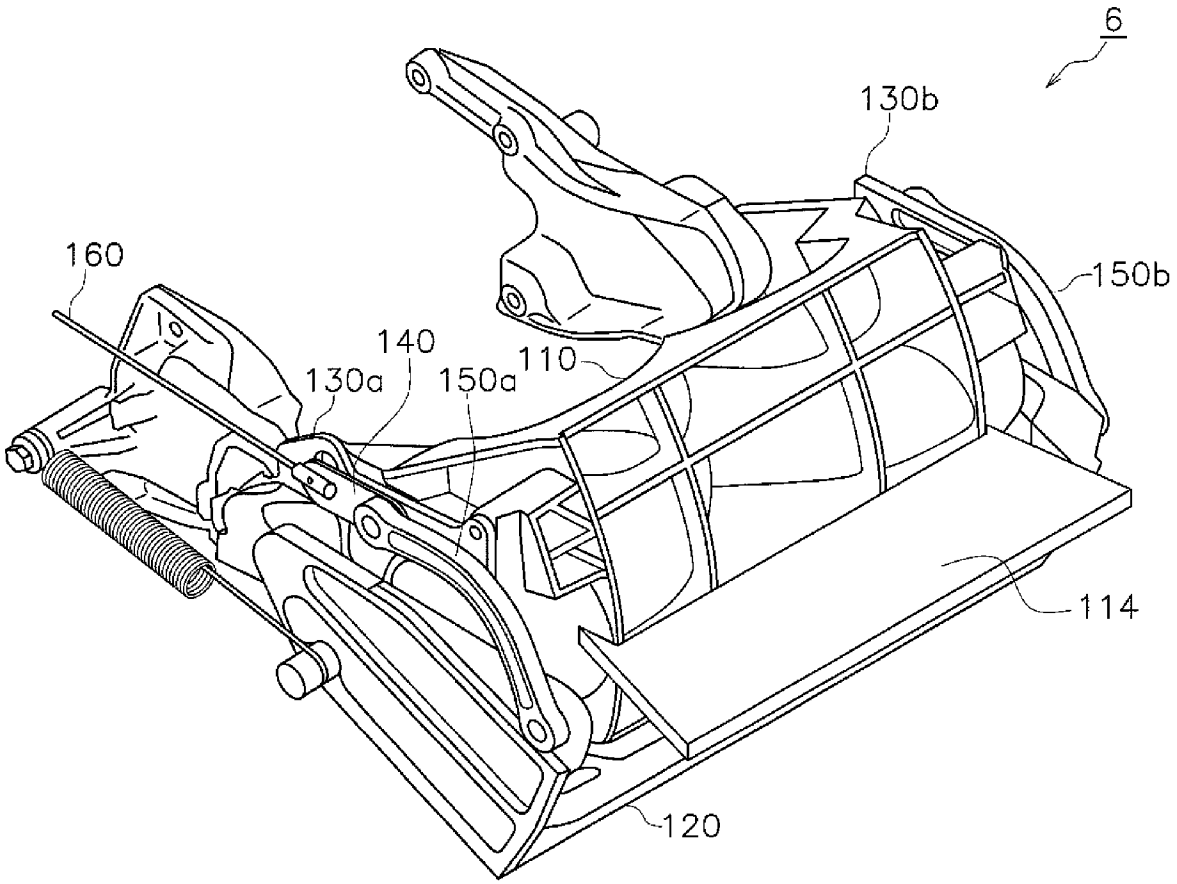
FIG. 2 is a perspective view of the reverse gate according to the first preferred embodiment of the present invention.
Figure 3:
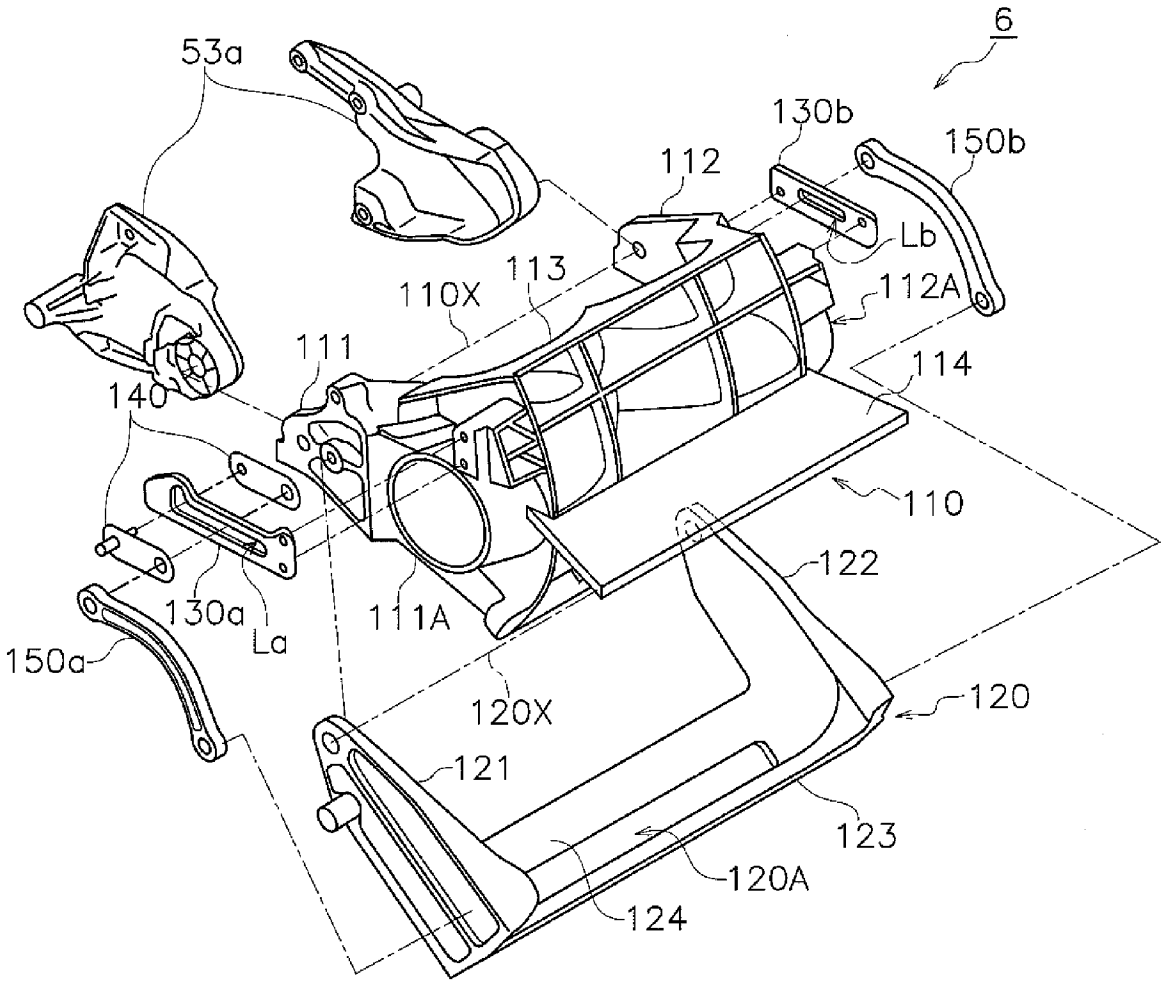
FIG. 3 is an exploded perspective view of the reverse gate according to the first preferred embodiment of the present invention.
Figure 4:
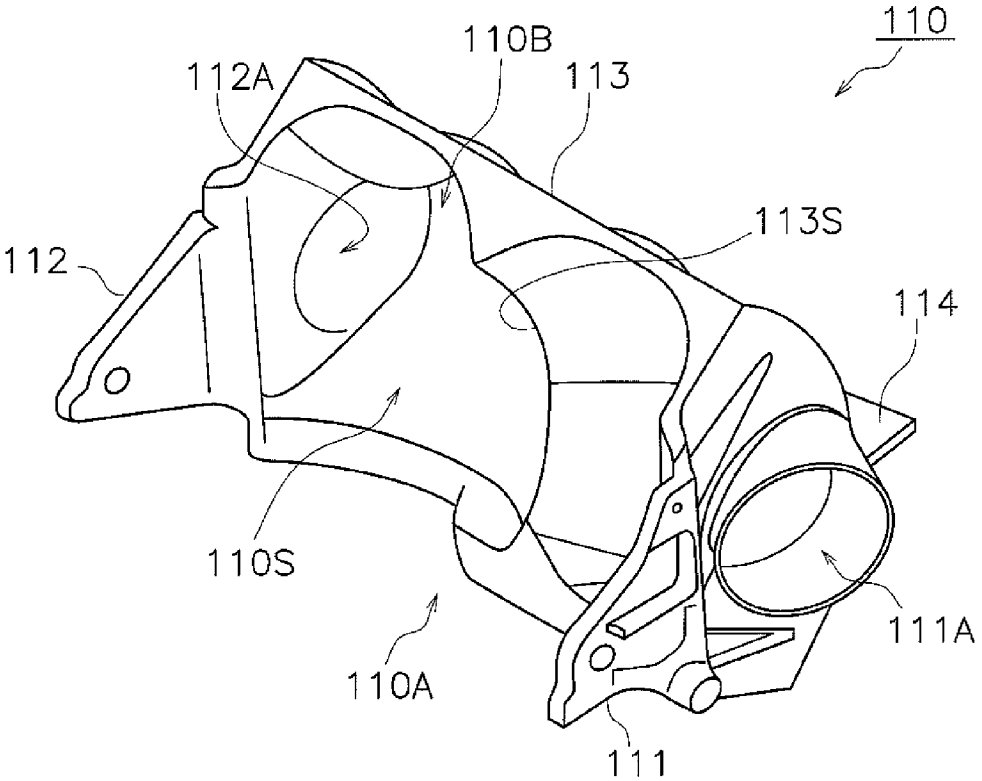
FIG. 4 is a perspective view of an inner bucket according to the first preferred embodiment of the present invention.

FIG. 2 is a perspective view of the reverse gate 6 according to the first preferred embodiment. FIG. 3 is an exploded perspective view of the reverse gate 6 according to the first preferred embodiment. FIG. 4 is a perspective view of an inner bucket 110 according to the first preferred embodiment. In the following explanation, "up", "down", "front", and "back" are expressions based on the reverse gate 6 in the neutral position (see FIG. 6).

The reverse gate 6 includes the inner bucket 110 (an example of a first member), an outer bucket 120 (an example of a second member), a pair of guide brackets 130*a* and 130*b*, a slider 140, a pair of link members 150*a* and 150*b*, and a rod 160.

The inner bucket 110 is supported by the supporting brackets 53*a* of the nozzle 53 so as to swing up and down about a first pivoting axis 110X parallel or substantially parallel to the lateral direction. The inner bucket 110 includes a left side plate 111, a right side plate 112, a back plate 113, and a gap covering plate 114 as shown in FIGS. 3 and 4.

The left side plate 111 is arranged to the left of the deflector 54. A left opening 111A is provided in the left side plate 111. The left opening 111A opens to the left. The right side plate 112 is arranged to the right of the deflector 54. The right side plate 112 faces the left side plate 111. A right opening 112A is provided in the right side plate 112. The right opening 112A opens to the right. The right opening 112A is symmetrical to the left opening 111A about the center of the reverse gate 6 in the lateral direction. In the present preferred embodiment, the left side plate 111 and the right side plate 112 are an example of a pair of side plates, and the left opening 111A and the right opening 112A are an example of a pair of lateral openings.

The back plate 113 is coupled to the left side plate 111 and the right side plate 112. The back plate 113 includes a projecting portion 113S that extends along the vertical direction. The projecting portion 113S is arranged in the center in the lateral direction of the reverse gate 6. The jet flow sprayed from the jet orifice 54*a* of the deflector 54 is divided to the right and left by the projecting portion 113S. Moreover, the inner surface of the back plate 113 is a three-dimensional curved surface on either side of the projecting portion 113S, and the jet flow divided to the right and left by the projecting portion 113S is guided to the left opening 111A and the right opening 112A.

A space 110S is provided on the inside of the left side plate 111, the right side plate 112, and the back plate 113 as shown in FIG. 4. While the space 110S is closed to the right and left by the left side plate 111 and the right side plate 112, the space 110S is open at the top and bottom. Specifically, the inner bucket 110 includes a downward opening 110A and an upward opening 110B. In the present preferred embodiment, the front edges of the downward opening 110A and the upward opening 110B are defined by an outer edge of the nozzle 53 attached to the inner bucket 110. The jet flow divided to the right and left by the projecting portion 113S of the back plate 113 is also guided to the downward opening 110A and the upward opening 110B.

The gap covering plate 114 is attached to the rear of the back plate 113. The gap covering plate 114 closes a gap between the inner bucket 110 and the outer bucket 120. The gap covering plate 114 prevents the escape of water flow backward or upward from the gap between the inner bucket 110 and the outer bucket 120.

The outer bucket 120 is arranged to the outside of the inner bucket 110. The outer bucket 120 is supported by the inner bucket 110 so as to swing up and down about a second pivoting shaft 120X parallel or substantially parallel to the lateral direction. The outer bucket 120 includes a left wall 121, a right wall 122, a back wall 123, and a jet flow restraint wall 124 as shown in FIG. 3.

The left wall 121 is arranged to the left of the inner bucket 110. The left wall 121 faces the left side plate 111 of the inner bucket 110. The right wall 122 is arranged to the right of the inner bucket 110. The right wall 122 faces the right side plate 112 of the inner bucket 110.

The jet flow restraint wall 124 is coupled to lower ends of both of the left wall 121 and the right wall 122. The jet flow restraint wall 124 preferably has a plate shape. The jet flow restraint wall 124 is arranged forward of the back wall 123. The jet flow restraint wall 124 is arranged below the downward opening 110A of the inner bucket 110. A flow outlet 120A that extends to the right and left is provided between the jet flow restraint wall 124 and the back wall 123.

The pair of guide brackets 130*a*, 130*b* is arranged respectively on the right and left sides of the inner bucket 110. A pair of guide rails La, Lb is provided on the pair of guide brackets 130*a*, 130*b* respectively.

The slider 140 includes two plate-shaped members that sandwich the guide bracket 130*a*. The slider 140 is slidably attached on the guide rail La of the guide bracket 130*a*.

The pair of link members 150*a*, 150*b* is slidably attached on the pair of guide rails La, Lb on the pair of guide brackets 130*a*, 130*b*. The slider 140 is fixed to the link member 150*a*.

The back end portion of the rod 160 is coupled to the slider 140 via a ball joint that is not illustrated. The front end portion of the rod 160 is coupled to an electric motor that is not illustrated. The inner bucket 110 and the outer bucket 120 are each interlocked and driven via the rod 160 by the electric motor which is driven in response to a shift operation by an operator.

Figure 5:
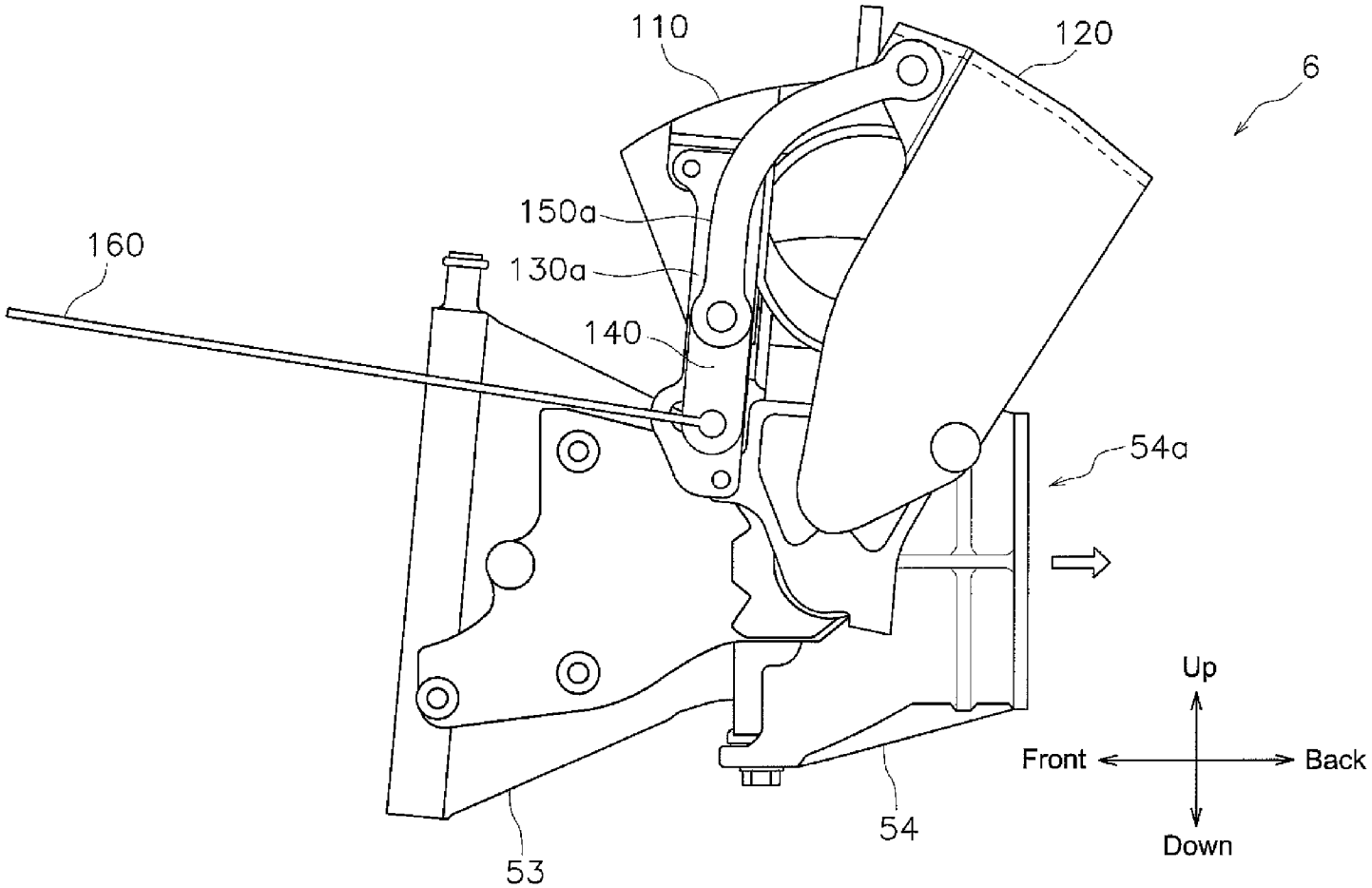
FIG. 5 is a side view of a configuration of the reverse gate in the forward movement position according to the first preferred embodiment of the present invention.
Figure 6:
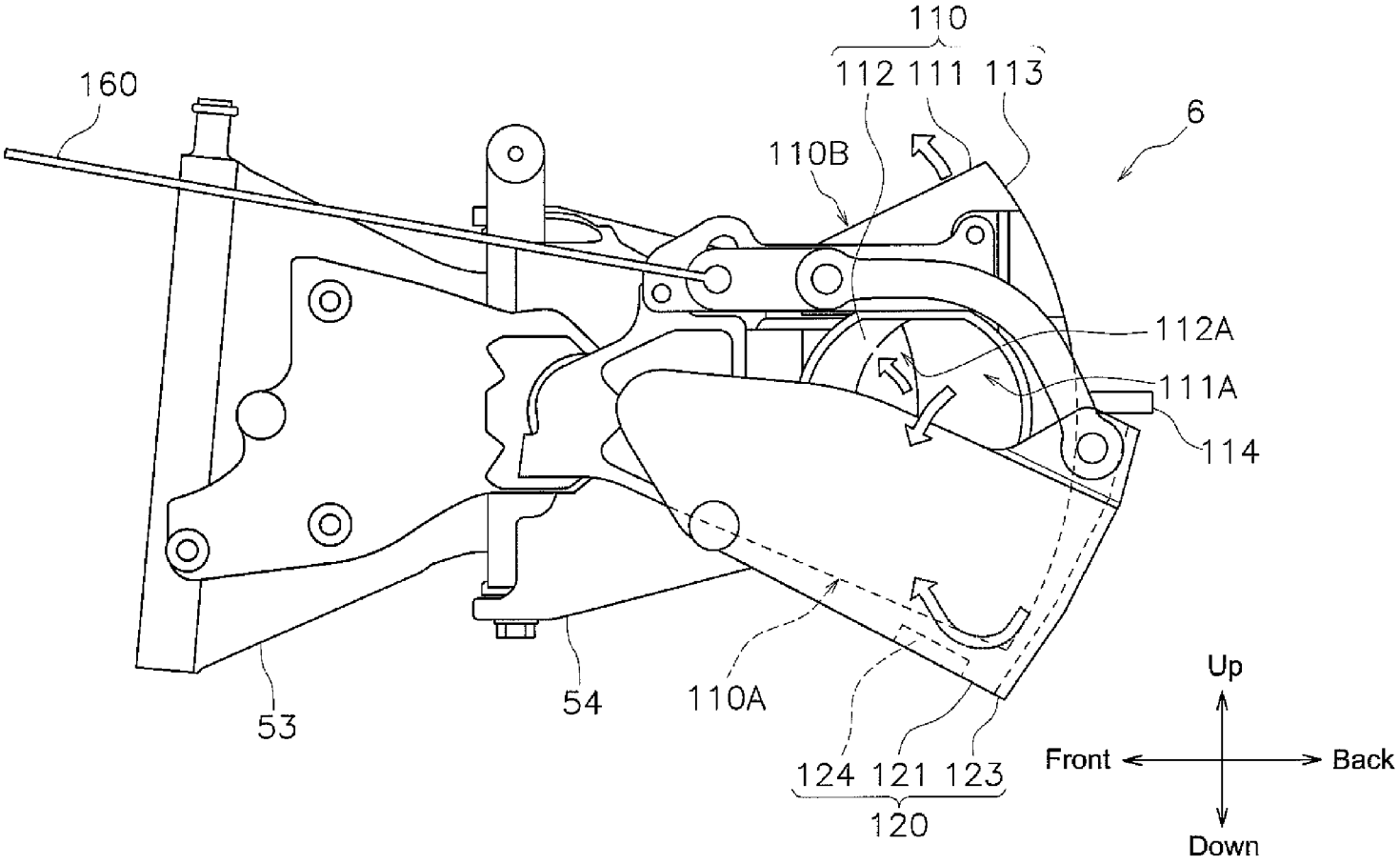
FIG. 6 is a side view of a configuration of the reverse gate in the neutral position according to the first preferred embodiment of the present invention.
Figure 7:
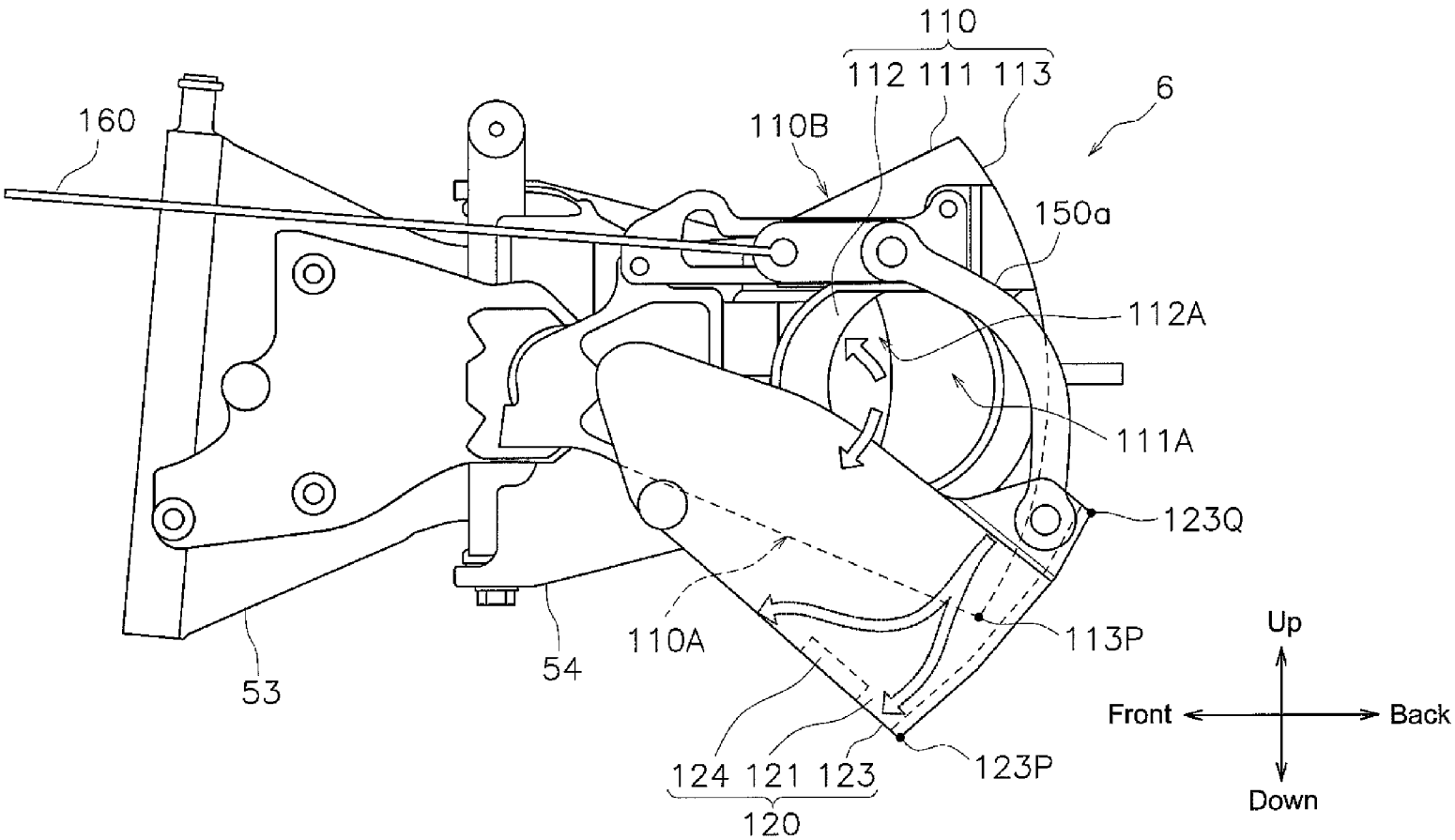
FIG. 7 is a side view of a configuration of the reverse gate in the reverse movement position according to the first preferred embodiment of the present invention.

FIG. 5 is a side view of a configuration of the reverse gate 6 in the forward movement position. FIG. 6 is a side view of a configuration of the reverse gate 6 in the neutral position. FIG. 7 is a side view of a configuration of the reverse gate 6 in the reverse movement position.

As shown in FIG. 5, the reverse gate 6 in the forward movement position is arranged above the deflector 54. Specifically, the rod 160 is pulled toward the front by the electric motor when the operator operates the shift so that the boat body moves forward. Consequently, the inner bucket 110 and the outer bucket 120 are both pulled upward above the deflector 54 via the slider 140 and the pair of link members 150*a*, 150*b* (only the link member 150*a* is shown in FIG. 5). In this way, the jet flow is sprayed backward from the jet orifice 54*a* since the inner bucket 110 and the outer bucket 120 are withdrawn from the rear of the jet orifice 54*a*. Consequently, the boat body 2 moves forward.

As shown in FIG. 6, the reverse gate 6 in the neutral position is arranged rearward of the deflector 54. Specifically, the rod 160 is pushed rearward by the electric motor when the operator operates the shift so that the boat body 2 that is moving forward is neutralized (caused to decelerate). Consequently, the inner bucket 110 and the outer bucket 120 are both lowered behind the deflector 54 via the slider 140 and the pair of link members 150*a*, 150*b*.

The outer bucket 120 is close to the lower end of the inner bucket 110 when the reverse gate 6 is in the neutral position. Specifically, the outer bucket 120 is mated to the inner bucket 110. As a result, a portion of the downward opening 110A of the inner bucket 110 is covered by the jet flow restraint wall 124 of the outer bucket 120. In the present preferred embodiment, approximately the rear half of the downward opening 110A is covered by the jet flow restraint wall 124. Therefore, the jet flow that is discharged from the jet orifice 54*a* and then guided along the inner surface of the back plate 113 of the inner bucket 110 to the downward opening 110A is diverted toward the inside of the inner bucket 110 by the jet flow restraint wall 124. In this way, the discharge of the jet flow downward from the downward opening 110A is prevented by the jet flow restraint wall 124 when the reverse gate 6 is in the neutral position.

Approximately the lower half of the left opening 111A of the inner bucket 110 only is covered by the left wall 121 of the outer bucket 120 and the upper half of the left opening 111A is open when the reverse gate 6 is in the neutral position. Similarly, approximately the lower half of the right opening 112A of the inner bucket 110 only is covered by the right wall 122 of the outer bucket 120 and the upper half of the right opening 112A is open. Therefore, the jet flow that is discharged from the jet orifice 54*a* and then guided along the inner surface of the back plate 113 to the left opening 111A and the right opening 112A, and the jet flow that is returned toward the inside of the inner bucket 110 by the jet flow restraint wall 124 is discharged from the left opening 111A and the right opening 112A.

Since the upward opening 110B of the inner bucket 110 is open in the present preferred embodiment, a portion of the jet flow discharged from the jet orifice 54*a* is discharged from the upward opening 110B.

As shown in FIG. 7, the reverse gate 6 in the reverse movement position is arranged rearward of the deflector 54. Specifically, the rod 160 is pushed farther rearward than when in the neutral position state by the electric motor when the operator operates the shift to cause the boat body 2 to move in the reverse direction. Consequently, the slider 140 is moved along the guide rail La (see FIG. 3) of the link member 150*a* and the outer bucket 120 is lowered downward below the neutral position state. In this way, the downward opening 110A of the inner bucket 110 is open since the outer bucket 120 is moved away from the lower end of the inner bucket 110. Therefore, the jet flow that is discharged from the jet orifice 54*a* and then guided along the inner surface of the back plate 113 to the downward opening 110A is discharged from the downward opening 110A. The jet flow discharged from the downward opening 110A is divided forward and downward by the jet flow restraint wall 124.

The left opening 111A and the right opening 112A of the inner bucket 110 are each about four-fifths open and the upward opening 110B is open when the reverse gate 6 is in the reverse movement position. As a result, a portion of the jet flow discharged from the jet orifice 54*a* is discharged from the left opening 111A, the right opening 112A, and the upward opening 110B.

When the reverse gate 6 is positioned in the reverse movement position, a lower end 123P of the back wall 123 of the outer bucket 120 is positioned farther forward than an upper end 123Q of the back wall 123. Specifically, the back wall 123 is arranged so as to incline backward. The lower end 123P of the back wall 123 is positioned farther forward than a lower end 113P of the back plate 113 of the inner bucket 110. As a result, a portion of the jet flow discharged from the downward opening 110A is guided forward along the inner surface of the back wall 123 as shown in FIG. 7.

Figure 8:
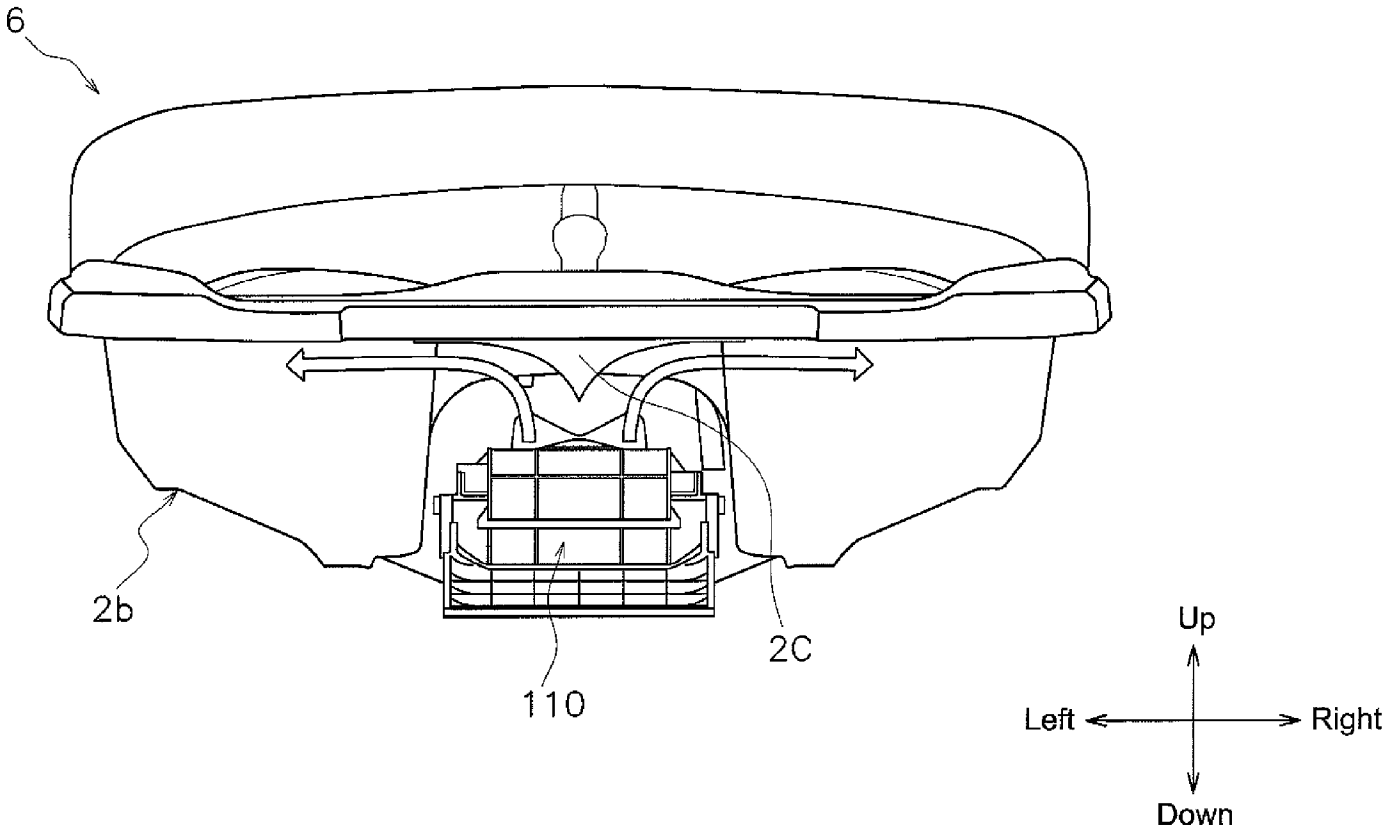
FIG. 8 is a top view of a configuration of a back end of the boat body according to the first preferred embodiment of the present invention.

FIG. 8 is a view of the boat body 2 according to the first preferred embodiment as seen from behind. FIG. 8 illustrates a state in which the reverse gate 6 is in the neutral position.

As shown in FIG. 8, a flow rectifying portion 2*c* is attached to the back end portion of the deck 2*a* of the boat body 2. The flow rectifying portion 2*c* is arranged in the center of the boat body 2 in the lateral direction. The flow rectifying portion 2*c* is arranged above the reverse gate 6. The flow rectifying portion 2*c* preferably has a tapered shape that projects downward. Specifically, the projecting width of the flow rectifying portion 2*c* is widest in the center in the lateral direction, and gradually decreases in width farther away from the center to the right and left. Therefore, the water flow heading toward the boat body 2 from the upward opening 110B of the inner bucket 110 is divided into the right and left flows by the flow rectifying portion 2*c*.

The reverse gate 6 includes the inner bucket 110 (an example of a first member) and the outer bucket 120 (an example of a second member). The inner bucket 110 includes the downward opening 110A that is open downward and the left opening 111A and the right opening 112A (examples of a pair of lateral openings) that are open to the right and left when the reverse gate 6 is positioned in the neutral position. The outer bucket 120 covers a portion of the downward opening 110A when the reverse gate 6 is positioned in the neutral position.

Figure 9:
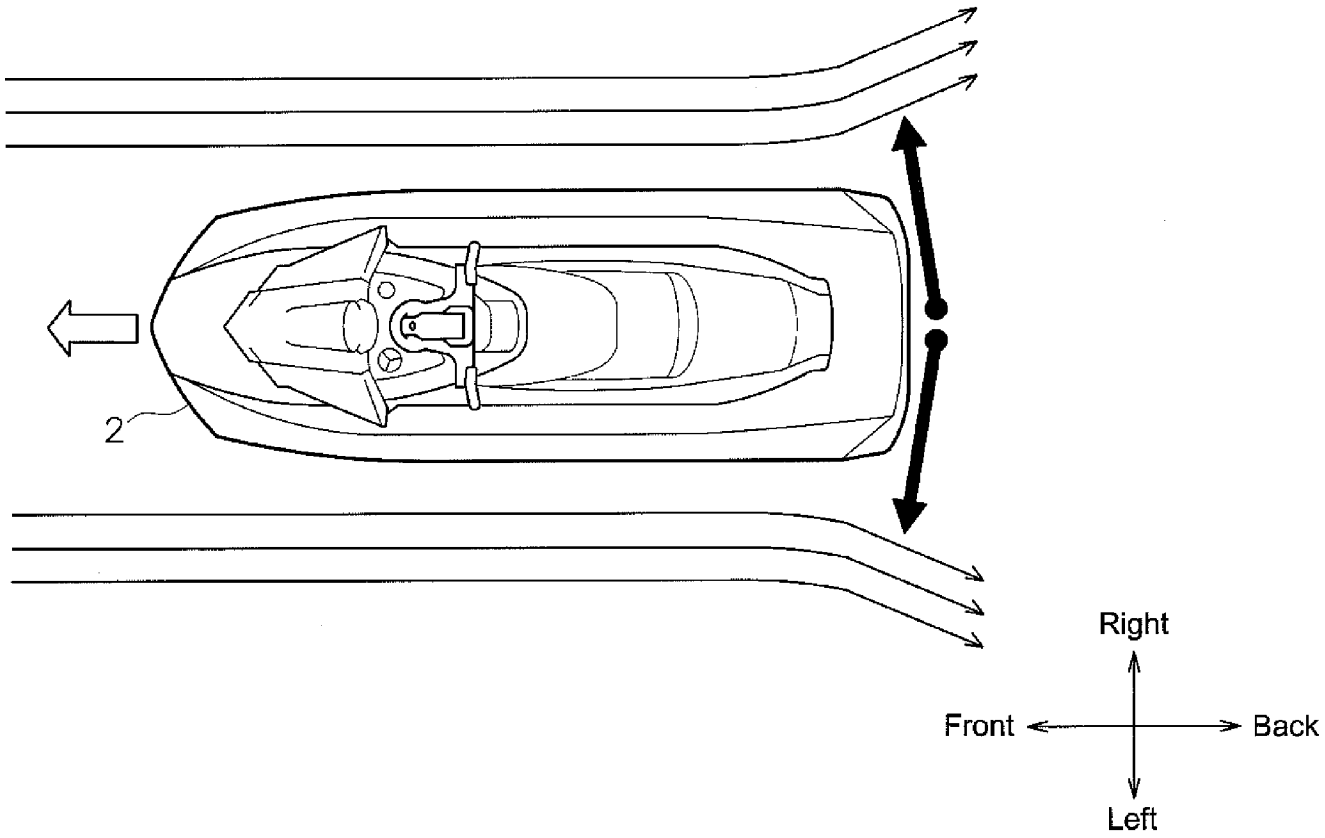
FIG. 9 is a top view showing the action of the boat body according to the first preferred embodiment of the present invention.

Therefore, when the reverse gate 6 is in the neutral position, the jet flow from the jet propulsion mechanism 5 is prevented from being discharged from the downward opening 110A and can be effectively discharged from the left opening 111A and the right opening 112A as shown in FIG. 9. As a result, effective deceleration is made possible due to the resistance of the water flow discharged to the right and left of the boat body 2. Further, since discharge from the downward opening 110A is prevented, the load on the boat body 2 in the vertical direction due to the jet flow can be minimized. Therefore, the occurrence of the phenomenon in which the bow of the boat sinks in the water (so-called bow diving) can be prevented since the change in the vertical direction of the boat body 2 can be reduced.

Figure 10:
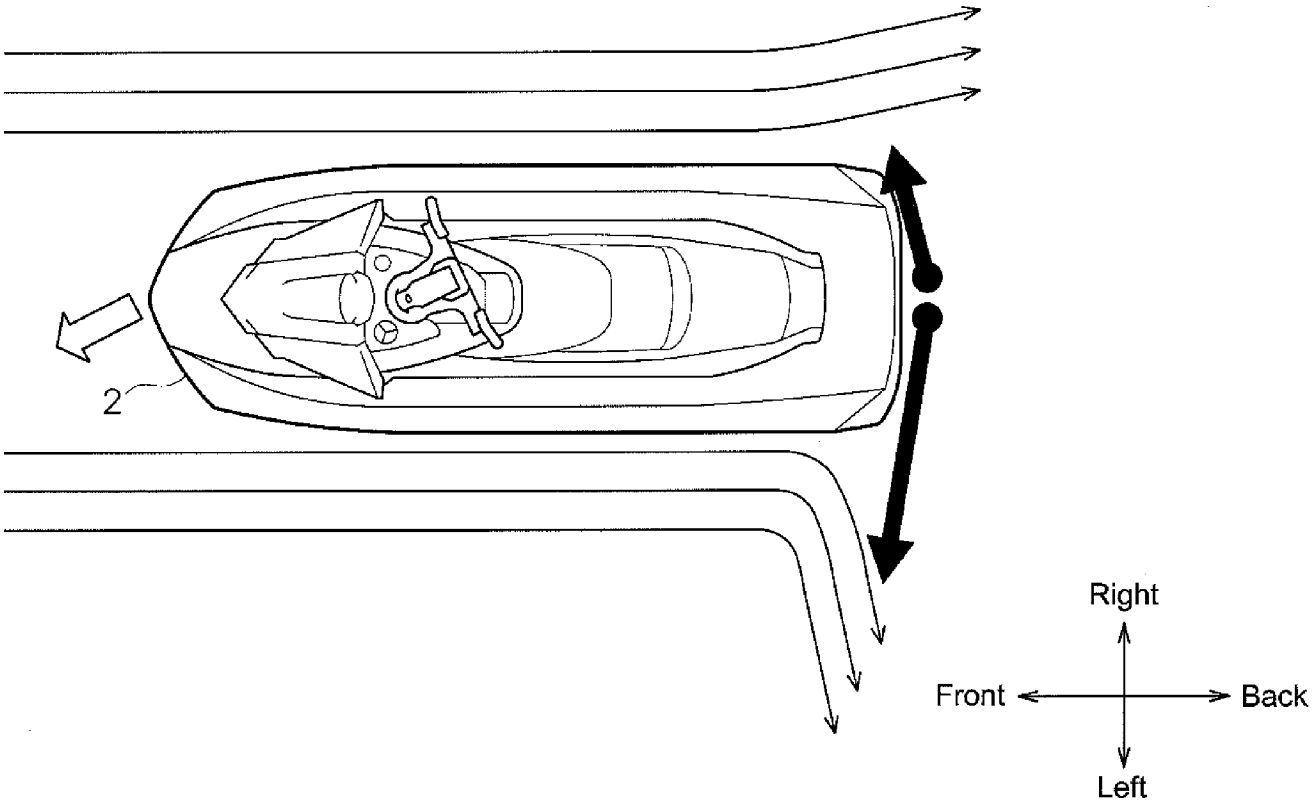
FIG. 10 is a top view showing the action of the boat body according to the first preferred embodiment of the present invention.

Moreover, since the resistance to the right and left of the boat body 2 is changed by changing the ratio of the division of the jet flow discharged to the right and left by the operation of the steering handle 8 during deceleration, the boat body 2 can be steered even during deceleration. Specifically, as shown in FIG. 10 for example, when the operator turns the steering handle 8 to the left, the amount of discharge from the left opening 111A becomes larger than the amount of discharge from the right opening 112A since the jet flow is discharged diagonally to the left and backward from the nozzle 53. Consequently, the boat body 2 can be steered to the left while decelerating since the resistance force due to the water flow discharged to the left side of the boat body 2 is greater than that to the right side.

The outer bucket 120 includes the jet flow restraint wall 124 that covers a portion of the downward opening 110A when the reverse gate 6 is positioned in the neutral position. The jet flow restraint wall 124 allows the downward opening 110A to be open when the reverse gate 6 is positioned in the neutral position.

Therefore, adjusting the opening and closing of the downward opening 110A can be performed with a simple configuration.

When the reverse gate 6 is positioned in the reverse movement position, the lower end 123P of the back wall 123 of the outer bucket 120 is positioned farther forward than the upper end 123Q of the back wall 123 and the lower end 113P of the back plate 113 of the inner bucket 110.

Therefore, a portion of the jet flow discharged from the downward opening 110A can be guided forward along the inner surface of the back wall 123. As a result, the boat body 2 can be made to move backwards effectively.

The inner bucket 110 includes the upward opening 110B that is open upward when the reverse gate 6 is positioned in the neutral position.

Therefore, the required strength of the inner bucket 110 can be reduced since the jet flow inside the inner bucket 110 is reduced. As a result, the inner bucket 110 can be made with a simple configuration and can be lightweight.

The boat body 2 includes the flow rectifying portion 2*c* that is provided in a tapered shape projecting downward.

The water flow escaping upward from the upward opening 110B as described above can be divided to the right and left by the flow rectifying portion 2*c*. Consequently, the resistance force of the water flow discharged to the right and left of the boat body 2 can be increased. As a result, the boat body 2 can be more effectively decelerated when the reverse gate 6 is positioned in the neutral position.

Second Preferred Embodiment

The following describes a schematic configuration of a jet propulsion boat according to a second preferred embodiment with reference to the drawings. The difference between the first and second preferred embodiments is the configuration of the reverse gate. Therefore, the following explanation will mainly refer to the configuration of the reverse gate.

Figure 11:
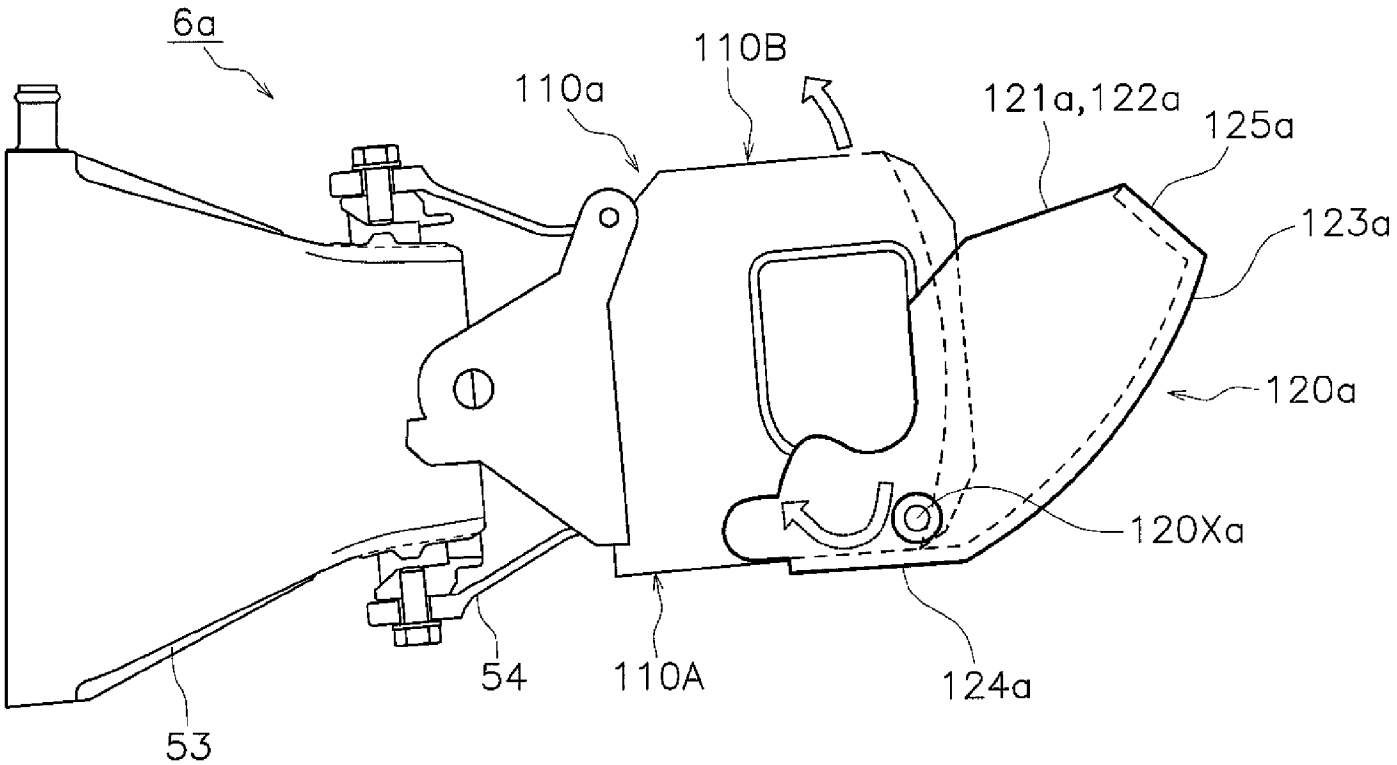
FIG. 11 is a side view of a configuration of the reverse gate in the neutral position according to a second preferred embodiment of the present invention.
Figure 12:
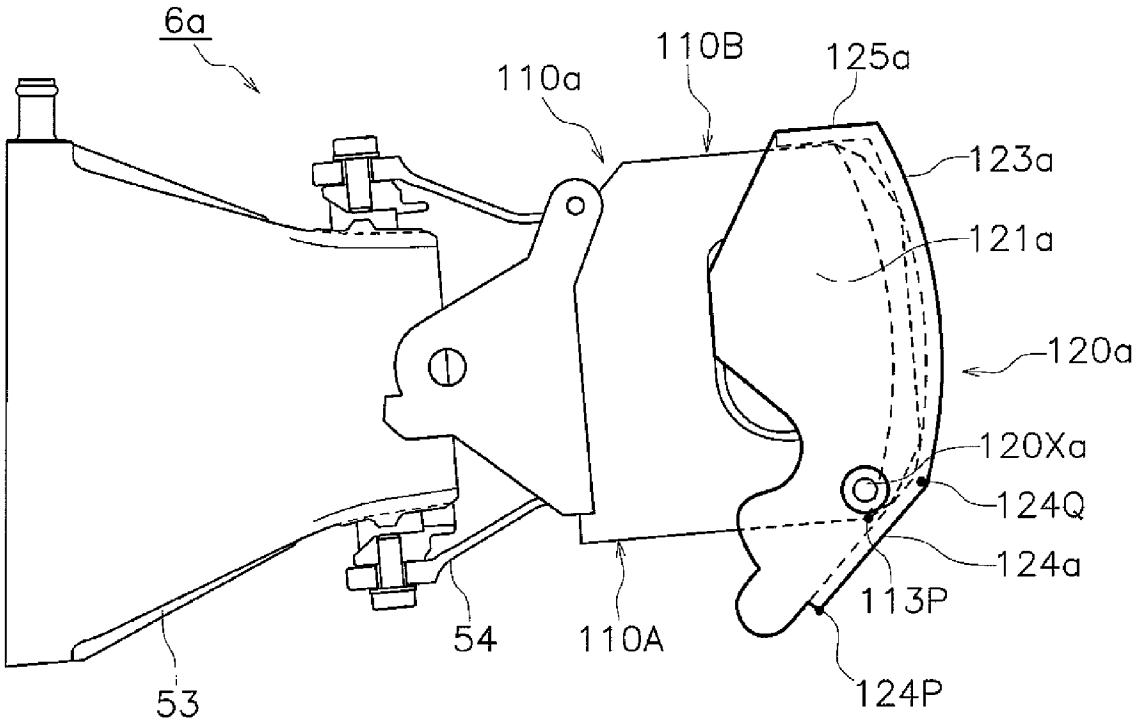
FIG. 12 is a side view of a configuration of the reverse gate in the reverse movement position according to the second preferred embodiment of the present invention.

FIG. 11 is a side view of a configuration of a reverse gate 6*a* in the neutral position. FIG. 12 is a side view of a configuration of the reverse gate 6*a* in the reverse movement position. A link mechanism arranged to drive the reverse gate 6*a* is omitted in FIGS. 11 and 12.

The reverse gate 6*a* includes an inner bucket 110*a* (an example of a first member) and an outer bucket 120*a* (an example of a second member).

The inner bucket 110*a* preferably has the same configuration as that of the inner bucket 110 according to the above-described first preferred embodiment.

The outer bucket 120*a* is arranged rearward of the inner bucket 110*a*. The outer bucket 120*a* is supported by the inner bucket 110*a* so as to swing back and forth about a pivoting shaft 120X parallel or substantially parallel to the lateral direction. The outer bucket 120*a* is inclined backward when the reverse gate 6*a* is positioned in the neutral position as shown in FIG. 11. The outer bucket 120*a* mates with the inner bucket 110*a* when the reverse gate 6*a* is positioned in the reverse movement position as shown in FIG. 12.

The outer bucket 120*a* includes a left wall 121*a*, a right wall 122*a*, a back wall 123*a*, a jet flow restraint wall 124*a*, and an upper wall 125*a*.

The left wall 121*a* is arranged to the left of the inner bucket 110*a*. The right wall 122*a* is arranged to the right of the inner bucket 110*a*. The left opening 111A and the right opening 112A are open when the reverse gate 6*a* is positioned in the neutral position. Conversely, at least a portion of the entire left opening 111A is covered by the left wall 121*a* and at least a portion of the entire right opening 112A is covered by the right wall 122*a* when the reverse gate 6*a* is positioned in the reverse movement position.

The back wall 123*a* is coupled with the left wall 121*a* and the right wall 122*a*.

The jet flow restraint wall 124*a* is connected to the left wall 121*a* and the right wall 122*a*. The jet flow restraint wall 124*a* is continuous with the bottom of the back wall 123*a*. The jet flow restraint wall 124*a* covers substantially the back half of the downward opening 110A of the inner bucket 110*a* when the reverse gate 6*a* is positioned in the neutral position as shown in FIG. 11. Consequently, the jet flow that is guided along the inner surface of the inner bucket 110*a* to the downward opening 110A is diverted toward the inside of the inner bucket 110*a* by the jet flow restraint wall 124*a*. Conversely, the jet flow restraint wall 124*a* moves away from the downward opening 110A when the reverse gate 6*a* is positioned in the neutral position as shown in FIG. 12. Consequently, the jet flow is discharged from the opened downward opening 110A.

When the reverse gate 6*a* is positioned in the reverse movement position, a lower end 124P of the jet flow restraint wall 124*a* is positioned farther forward than an upper end 124Q of the jet flow restraint wall 124*a*. Specifically, the jet flow restraint wall 124*a* is arranged to be inclined backward. The lower end 124P of the jet flow restraint wall 124*a* is positioned farther forward than a lower end 113P of the back plate 113 of the inner bucket 110*a*. As a result, the jet flow that is guided along the inner surface of the inner bucket 110*a* to the downward opening 110A is guided forward along the inner surface of the jet flow restraint wall 124*a*.

The upper wall 125*a* is connected to the left wall 121*a* and the right wall 122*a*. The upper wall 125*a* is continuous with the top of the back wall 123*a*. The upper wall 125*a* moves away from the upward opening 110B when the reverse gate 6*a* is positioned in the neutral position as shown in FIG. 11. Consequently, the jet flow guided along the inner surface of the inner bucket 110*a* to the upward opening 110B is discharged from the opened upward opening 110B. Conversely, the upper wall 125*a* covers approximately the back half of the upward opening 110B of the inner bucket 110*a* when the reverse gate 6*a* is positioned in the reverse movement position as shown in FIG. 12. Consequently, the jet flow that is guided along the inner surface of the inner bucket 110*a* to the upward opening 110B is diverted toward the inside of the inner bucket 110*a* by the upper wall 125*a*.

When the reverse gate 6*a* is positioned in the reverse movement position, the lower end 124P of the jet flow restraint wall 124*a* is positioned farther forward than the upper end 124Q of the jet flow restraint wall 124*a*. The lower end 124P of the jet flow restraint wall 124*a* is positioned farther forward than the lower end 113P of the back plate 113 of the inner bucket 110*a*.

Therefore, a portion of the jet flow discharged from the downward opening 110A can be guided forward along the inner surface of the jet flow restraint wall 124*a*. As a result, the boat body 2 can be made to move backwards effectively.

When the reverse gate 6*a* is positioned in the reverse movement position, the left wall 121*a* and the right wall 122*a* (example of a pair of lateral walls) respectively cover portions of the left opening 111A and the right opening 112A.

Therefore, the amount of jet flow discharged from the downward opening 110A can be increased due to the jet flow from the left opening 111A and the right opening 112A being prevented from flowing out. As a result, the boat body 2 can be made to move backwards more effectively.

The outer bucket 120*a* includes the upper wall 125*a* that covers a portion of upward opening 110B when the reverse gate 6 is positioned in the reverse movement position.

Therefore, the amount of jet flow discharged from the downward opening 110A can be increased due to the jet flow from the upward opening 110B being prevented from flowing out. As a result, the boat body 2 can be made to move backwards more effectively.

Third Preferred Embodiment

The following describes a configuration outline of a jet propulsion boat according to a third preferred embodiment with reference to the drawings. The difference between the first and third preferred embodiments is the configuration of the reverse gate. Therefore, the following explanation will mainly refer to the configuration of the reverse gate.

Figure 13:
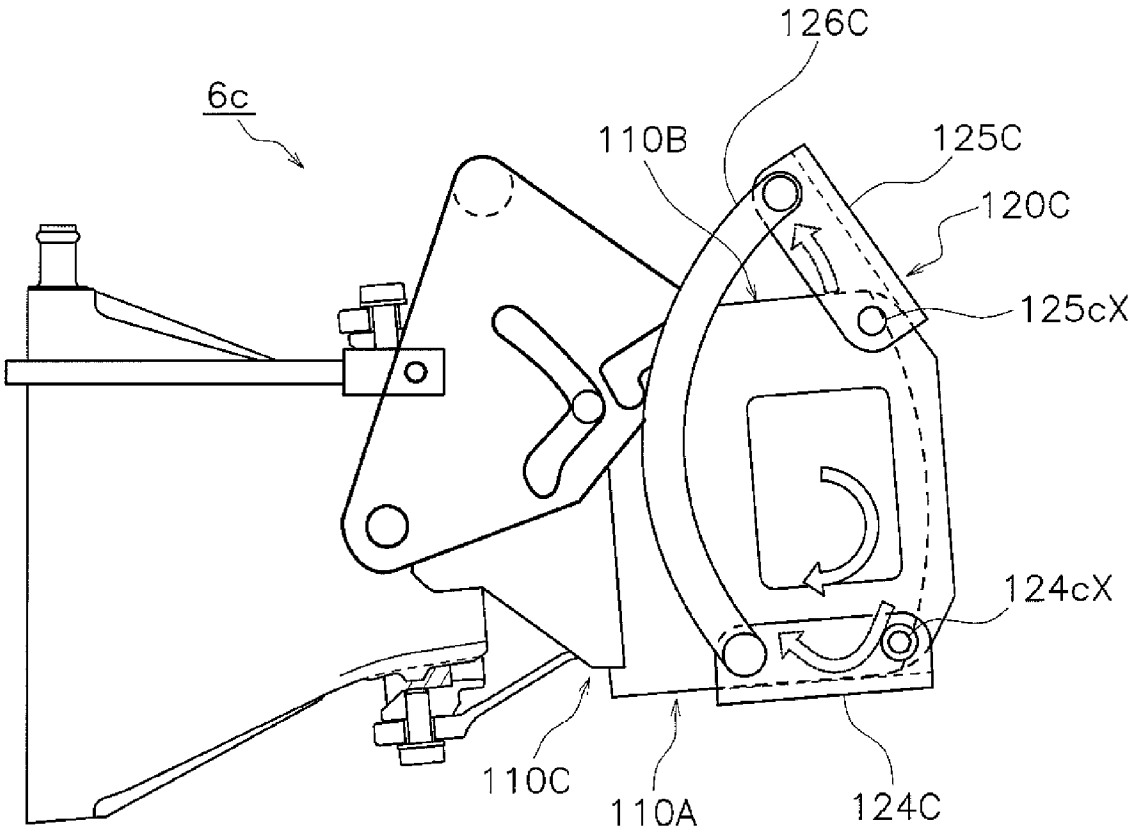
FIG. 13 is a side view of a configuration of the reverse gate in the neutral position according to a third preferred embodiment of the present invention.
Figure 14:
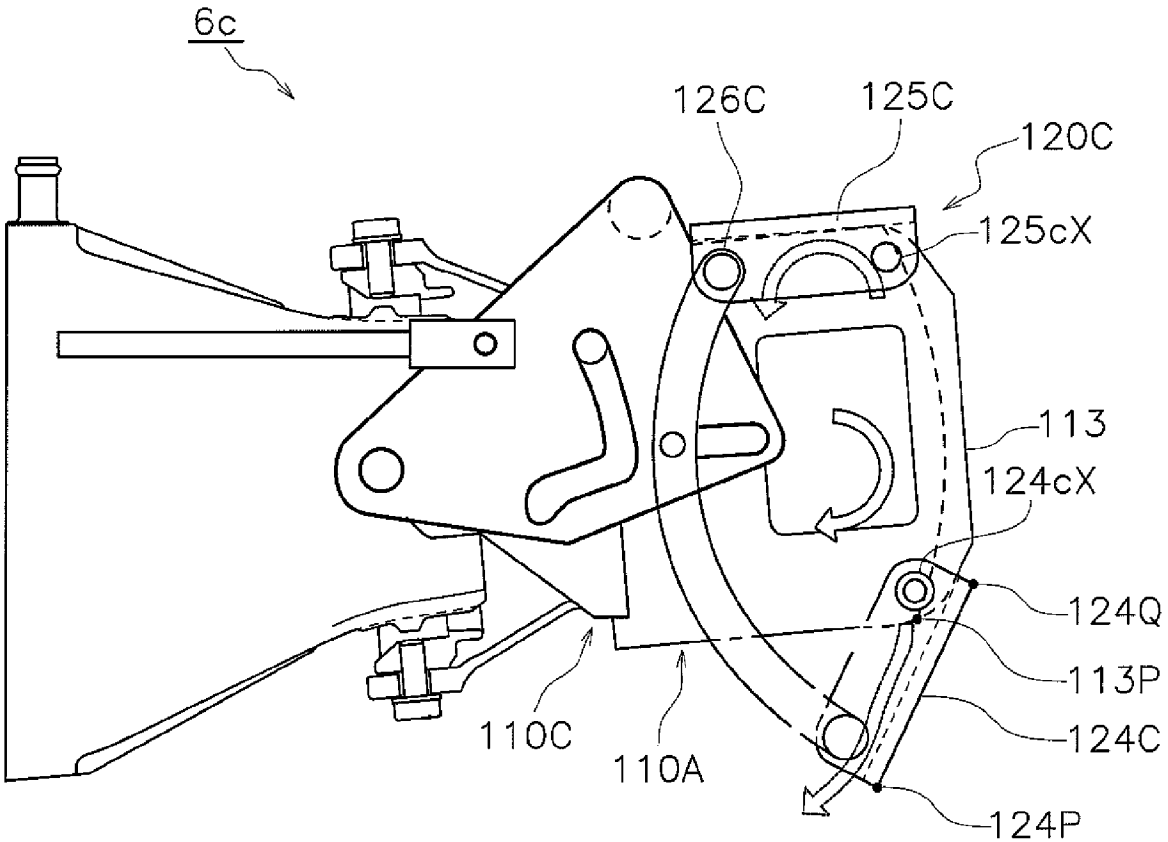
FIG. 14 is a side view of a configuration of the reverse gate in the reverse movement position according to the third preferred embodiment of the present invention.

FIG. 13 is a side view of a configuration of a reverse gate 6*c* in the neutral position. FIG. 14 is a side view of a configuration of the reverse gate 6*c* in the reverse movement position.

The reverse gate 6*c* includes an inner bucket 110*c* (an example of a first member) and an outer bucket 120*c* (an example of a second member).

The inner bucket 110*c* preferably has the same configuration as the inner bucket 110 according to the above-described first preferred embodiment.

The outer bucket 120*c* is arranged to the outside of the inner bucket 110*c*. The outer bucket 120*c* includes a jet flow restraint wall 124*c*, an upper wall 125*c*, and a linking bracket 126*c*.

The jet flow restraint wall 124*c* is arranged below the inner bucket 110*c*. The jet flow restraint wall 124*c* is supported by the inner bucket 110*c* to pivot around a pivoting axis 124*c*X. The jet flow restraint wall 124*c* covers substantially the back half of the downward opening 110A of the inner bucket 110*c* when the reverse gate 6*c* is positioned in the neutral position as shown in FIG. 13. Consequently, the jet flow that is guided along the inner surface of the inner bucket 110*c* to the downward opening 110A is diverted toward the inside of the inner bucket 110*c* by the jet flow restraint wall 124*c*. Conversely, the jet flow restraint wall 124*c* moves away from the downward opening 110A when the reverse gate 6*c* is positioned in the reverse movement position as shown in FIG. 14. Consequently, the jet flow is discharged from the opened downward opening 110A.

When the reverse gate 6*c* is positioned in the reverse movement position, a lower end 124P of the jet flow restraint wall 124*c* is positioned farther forward than an upper end 124Q of the jet flow restraint wall 124*c*. Specifically, the jet flow restraint wall 124*c* is arranged to be inclined backward. The lower end 124P of the jet flow restraint wall 124*c* is positioned farther forward than a lower end 113P of the back plate 113 of the inner bucket 110*c*. As a result, the jet flow that is guided along the inner surface of the inner bucket 110*c* to the downward opening 110A is guided forward along the inner surface of the jet flow restraint wall 124*c* as shown in FIG. 13.

The upper wall 125*c* is arranged above the inner bucket 110*c*. The upper wall 125*c* is supported by the inner bucket 110*c* to pivot around a pivoting axis 125*c*X. The upper wall 125*c* moves away from the upward opening 110B when the reverse gate 6*c* is positioned in the neutral position as shown in FIG. 13. Consequently, the jet flow guided along the inner surface of the inner bucket 110*c* to the upward opening 110B is discharged from the opened upward opening 110B. Conversely, the upper wall 125*c* covers approximately the back half of the upward opening 110B of the inner bucket 110*c* when the reverse gate 6*c* is positioned in the reverse movement position as shown in FIG. 14. Consequently, the jet flow that is guided along the inner surface of the inner bucket 110*c* to the upward opening 110B is diverted toward the inside of the inner bucket 110*c* by the upper wall 125*c*.

The linking bracket 126*c* is connected to the jet flow restraint wall 124*c* and the upper wall 125*c*. The jet flow restraint wall 124*c* and the upper wall 125*c* are interlocked and pivoted in response to the linking bracket 126*c* being moved up and down by the link mechanism.

The reverse gate 6*c* includes the inner bucket 110*c* (an example of a first member) and the outer bucket 120*c* (an example of a second member). The inner bucket 110*c* includes the downward opening 110A that is open downward and the left opening 111A and the right opening 112A (examples of a pair of lateral openings) that are open to the right and left when the reverse gate 6*c* is positioned in the neutral position. The outer bucket 120*c* covers a portion of the downward opening 110A when the reverse gate 6*c* is positioned in the neutral position.

Therefore, when the reverse gate 6*c* is positioned in the neutral position, the jet flow from the jet propulsion mechanism 5 is prevented from being discharged from the downward opening 110A and can be effectively discharged from the left opening 111A and the right opening 112A. As a result, effective deceleration is made possible due to the resistance force of the water flow discharged to the right and left of the boat body 2 while preventing bow diving. Moreover, the boat body 2 can be steered even during deceleration by the operation of the steering handle 8 during deceleration.

When the reverse gate 6*c* is positioned in the reverse movement position, the lower end 124P of the jet flow restraint wall 124*c* is positioned farther forward than the upper end 124Q of the jet flow restraint wall 124*c*. The lower end 124P of the jet flow restraint wall 124*c* is positioned farther forward than the lower end 113P of the back plate 113 of the inner bucket 110*c*.

Therefore, a portion of the jet flow discharged from the downward opening 110A can be guided forward along the inner surface of the jet flow restraint wall 124*c*. As a result, the boat body 2 can be made to move backwards effectively.

The outer bucket 120*c* includes the upper wall 125*c* that covers a portion of the upward opening 110B when the reverse gate 6*c* is positioned in the reverse movement position.

Therefore, the amount of jet flow discharged from the downward opening 110A can be increased due to the jet flow from the upward opening 110B being prevented from flowing out. As a result, the boat body 2 can be made to move backwards more effectively.

Other Preferred Embodiments

Although preferred embodiments of the present invention have been described so far, the present invention is not limited to the above-described preferred embodiments and various modifications may be made within the scope of the present invention.

In the above-described preferred embodiments, the jet flow restraint wall 124 is described as preferably covering substantially the back half of the downward opening 110A when the reverse gate 6 is positioned in the neutral position. However, the preferred embodiments are not limited as such. The jet flow restraint wall 124 may cover at least a portion of the downward opening 110A and may cover the forward side of the downward opening 110A.

Similarly, the left wall 121 and the right wall 122 may cover at least a portion respectively of the left opening 111A and the right opening 112A. Further, the upper wall 125 may cover at least a portion of the upward opening 110B.

In the above-described preferred embodiments, the left wall 121 and the right wall 122 are described as allowing the left opening 111A and the right opening 112A to be opened widely when the reverse gate 6 is positioned in the reverse movement position. However, the preferred embodiments are not limited as such. The left wall 121 and the right wall 122 may cover a large portion of the left opening 111A and the right opening 112A when the reverse gate 6 is positioned in the reverse movement position. In this case, the boat body 2 can be made to move backwards more effectively since the amount of jet flow from the downward opening 110A can be increased.

In the above-described preferred embodiments, the outer bucket 120 that is an example of the second member is described as arranged to the outside of the inner bucket 110 that is an example of the first member. However, the preferred embodiments are not limited as such. The second member may be arranged inside the first member. In this case, the jet flow restraint wall 124 covers the inside of the downward opening 110A.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A jet propulsion boat comprising:

a boat body;

an engine housed in the boat body;

a jet propulsion mechanism arranged to generate a propulsion power based on a driving power from the engine; and a reverse gate arranged rearward of the jet propulsion mechanism, the reverse gate arranged to be moved to a forward movement position that allows a jet flow from the jet propulsion mechanism to flow backward, a reverse movement position that allows the jet flow from the jet propulsion mechanism to flow forward and downward, and a neutral position that allows the jet flow from the jet propulsion mechanism to flow in a lateral direction; wherein the reverse gate includes a first member and a second member;

the first member includes a downward opening and a pair of lateral openings, the downward opening opens downward and the pair of lateral openings open to a right side and to a left side when the reverse gate is positioned in the neutral position; and the second member covers at least a portion of the downward opening when the reverse gate is positioned in the neutral position.

2. The jet propulsion boat according to claim 1, wherein the second member is arranged outside of the first member.

3. The jet propulsion boat according to claim 1, wherein the second member includes a jet flow restraint wall which covers at least a portion of the downward opening when the reverse gate is in the neutral position.

4. The jet propulsion boat according to claim 3, wherein the jet flow restraint wall allows the downward opening to be open when the reverse gate is in the reverse movement position.

5. The jet propulsion boat according to claim 4, wherein the first member includes a pair of side plates and a back plate;

the pair of lateral openings are provided in the pair of side plates;

the back plate faces the jet propulsion mechanism when the reverse gate is in the reverse movement position; and a lower end of the jet flow restraint wall is positioned below and forward of a lower end of the back plate and is positioned forward of an upper end of the jet flow restraint wall when the reverse gate is positioned in the reverse movement position.

6. The jet propulsion boat according to claim 4, wherein the first member includes a pair of side plates and a back plate;

the pair of lateral openings are provided in the pair of side plates;

the back plate faces the jet propulsion mechanism when the reverse gate is in the reverse movement position;

the second member includes a back wall including a lower end and an upper end;

the lower end of the back wall is positioned forward of the upper end when the reverse gate is in the reverse movement position; and the lower end of the back wall is positioned forward of a lower end of the back plate when the reverse gate is in the reverse movement position.

7. The jet propulsion boat according to claim 1, wherein the second member includes a pair of lateral walls, and the pair of lateral walls cover at least a portion of the pair of lateral openings when the reverse gate is in the reverse movement position.

8. The jet propulsion boat according to claim 1, wherein the second member is pivotably attached to the first member.

9. The jet propulsion boat according to claim 1, wherein the first member includes an upward opening, and the upward opening is open upward when the reverse gate is in the neutral position.

10. The jet propulsion boat according to claim 9, wherein the second member includes an upper wall, and the upper wall covers at least a portion of the upward opening when the reverse gate is in the reverse movement position.

11. The jet propulsion boat according to claim 9, wherein the boat body includes a flow rectifying portion, the flow rectifying portion is tapered downward in a center of the boat body in the lateral direction, and the flow rectifying portion divides a water flow flowing toward the boat body from the upward opening to the right side and to the left side.

* * * * *